United States Patent [19]

Stietenroth

[11] 4,245,336

[45] Jan. 13, 1981

[54] ELECTRONIC TONE GENERATOR

[75] Inventor: Horst Stietenroth, Glinde, Fed. Rep. of Germany

[73] Assignee: RCA Corporation, New York, N.Y.

[21] Appl. No.: 952,349

[22] Filed: Oct. 18, 1978

[30] Foreign Application Priority Data

Sep. 28, 1978 [GB] United Kingdom ..... 38575/78

[51] Int. Cl.[3] ..... G04B 21/02; G10H 1/00

[52] U.S. Cl. ..... 368/75; 368/273; 84/1.03; 84/1.19; 84/1.01

[58] Field of Search ..... 58/12-14, 58/38 R; 84/1.01, 1.03, 1.11, 1.19; 328/38, 14, 16, 151

[56] References Cited

U.S. PATENT DOCUMENTS

| | | | |
|---|---|---|---|
| 3,610,800 | 10/1971 | Deutsch | 84/1.01 |
| 3,854,365 | 12/1974 | Tomisawa et al. | 84/1.01 |
| 4,003,003 | 1/1977 | Haeberlin | 332/11 R |
| 4,053,839 | 10/1977 | Knoedl, Jr. | 328/38 |
| 4,063,484 | 12/1977 | Robinson | 84/1.24 |
| 4,073,133 | 2/1978 | Earls et al. | 58/13 |
| 4,098,071 | 7/1978 | Kanakami et al. | 58/39 |
| 4,149,440 | 4/1979 | DeForeit | 84/1.01 |

FOREIGN PATENT DOCUMENTS

| | | | |
|---|---|---|---|
| 1176760 | 1/1970 | United Kingdom | 84/1.01 |
| 1245678 | 9/1971 | United Kingdom | 84/1.01 |

*Primary Examiner*—Vit W. Miska
*Attorney, Agent, or Firm*—Harold Christoffersen; Samuel Cohen; Donald W. Phillion

[57] ABSTRACT

A digitized multifrequency tone generator comprising a memory having N readable word locations with each location containing an amplitude representing binary word, and with the total N binary words sequentially and collectively representing a period $T_o$ of the waveform of a multifrequency tone such as a chime with certain harmonics contained therein. Memory scanning signals of frequencies $Nf_o$, where $f_o=f_1, f_2 \ldots f_n$, are each employed, one at a time in a predetermined chime sequence, to repeatedly and sequentially read the N words from the memory to form a sequence of chimes each of whose fundamental tone frequencies is equal to the employed scanning frequency $f_o=f_{o1}, f_{o2} \ldots f_n$, with the said harmonics being reproduced at the proper frequency relative to each scanning frequency. A digital-to-analog device converts the read out binary words to form the aforementioned waveform. Logic means are provided to control the duration and decay characteristics of each generated tone.

10 Claims, 11 Drawing Figures

ELECTRONIC TONE GENERATOR

This invention relates generally to the generation of periodic waveforms and more particularly, to the generation of the chimes of an electronic clock by digital means.

There are several known means for generating chimes by digitized means. Generally, such prior art means synthesize the tones by generating voltages of certain basic frequencies which are then divided or multiplied by digitized dividers or multipliers to produce the various signal frequencies which make up a chime sequence, a chime sequence consisting of one or more successively occurring chimes, each consisting of a tone having fundamental frequency and certain harmonics thereof. Appropriate attenuation means are provided to attenuate the tone representing voltages at the proper time rate to simulate the auditory decay of sound which occurs after a bell or chime pipe is struck with a hammer. Other means are provided to simulate the strong attack sound which occurs when the bell or chime pipe is first struck. Still other means function to keep track of real time to energize the proper tone generating circuits in accordance with the particular quarter hour time to be announced. Such foregoing electronic chime clocks are shown in U.S. Pat. No. 4,073,133 to Earls and U.S. Pat. No. 4,085,644 to Deutsch.

Tone generating means embodying the invention includes memory means containing N sequentially stored binary words representing successive amplitude samplings of a periodic multi-frequency stored waveform of period $T_o$ which contains predetermined harmonics of the fundamental tone frequency $f_o=1/T_o$ and accessing means for sequentially accessing said N binary words at a frequency $Nf_o$, where the accessing frequency $Nf_o$ can be any one of a plurality of frequencies $Nf_{o1}$, $Nf_{02}$ . . . $Nf_{on}$, with the accessing frequency thereby becoming the fundamental tone frequency of said multi-frequency waveform. Advantages of the present invention include its relative simplicity and relatively low cost.

Figure 1:
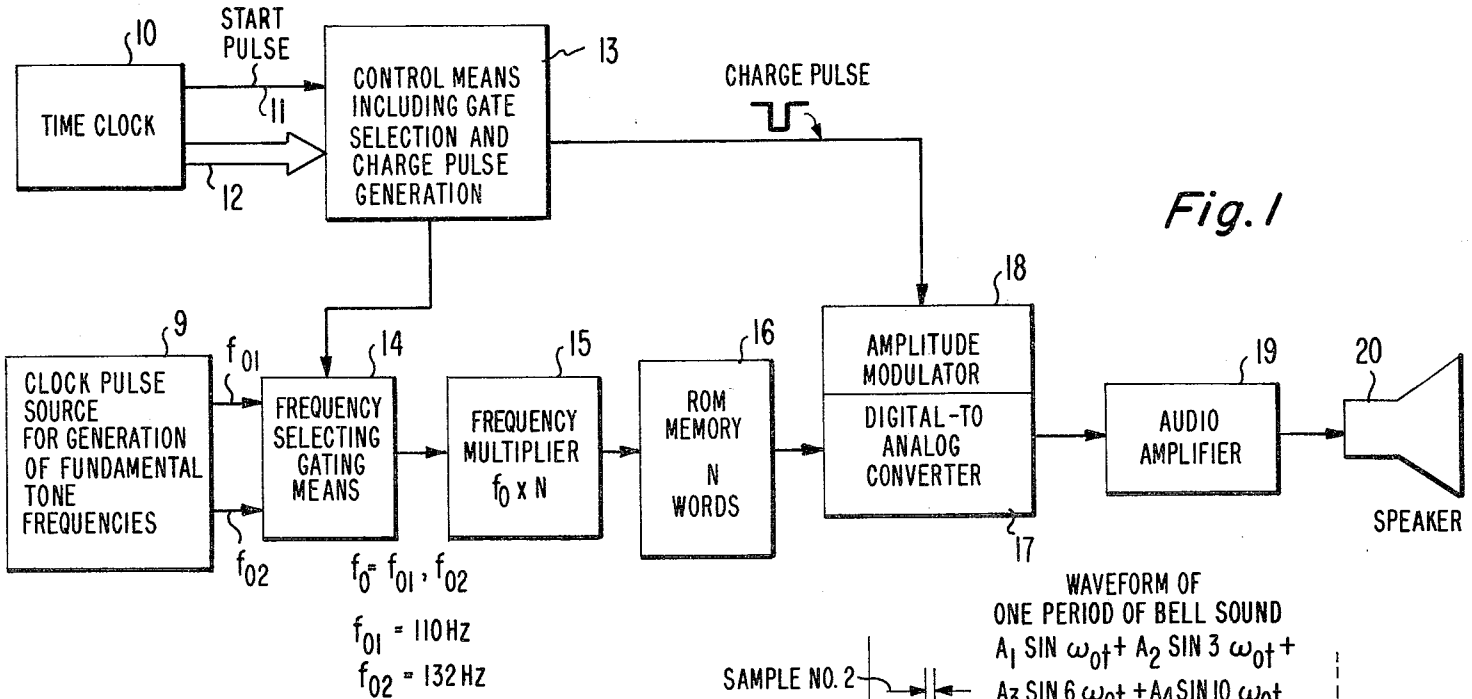
FIG. 1 is a block diagram of one form of the invention.
Figure 2:
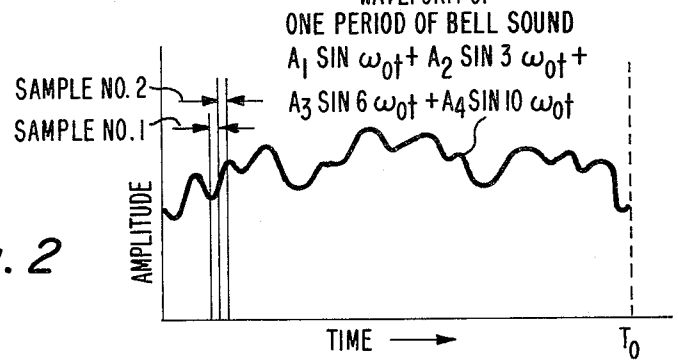
FIG. 2 is a waveform of one time period $T_o$ of a bell or pipe sound.
Figure 4:
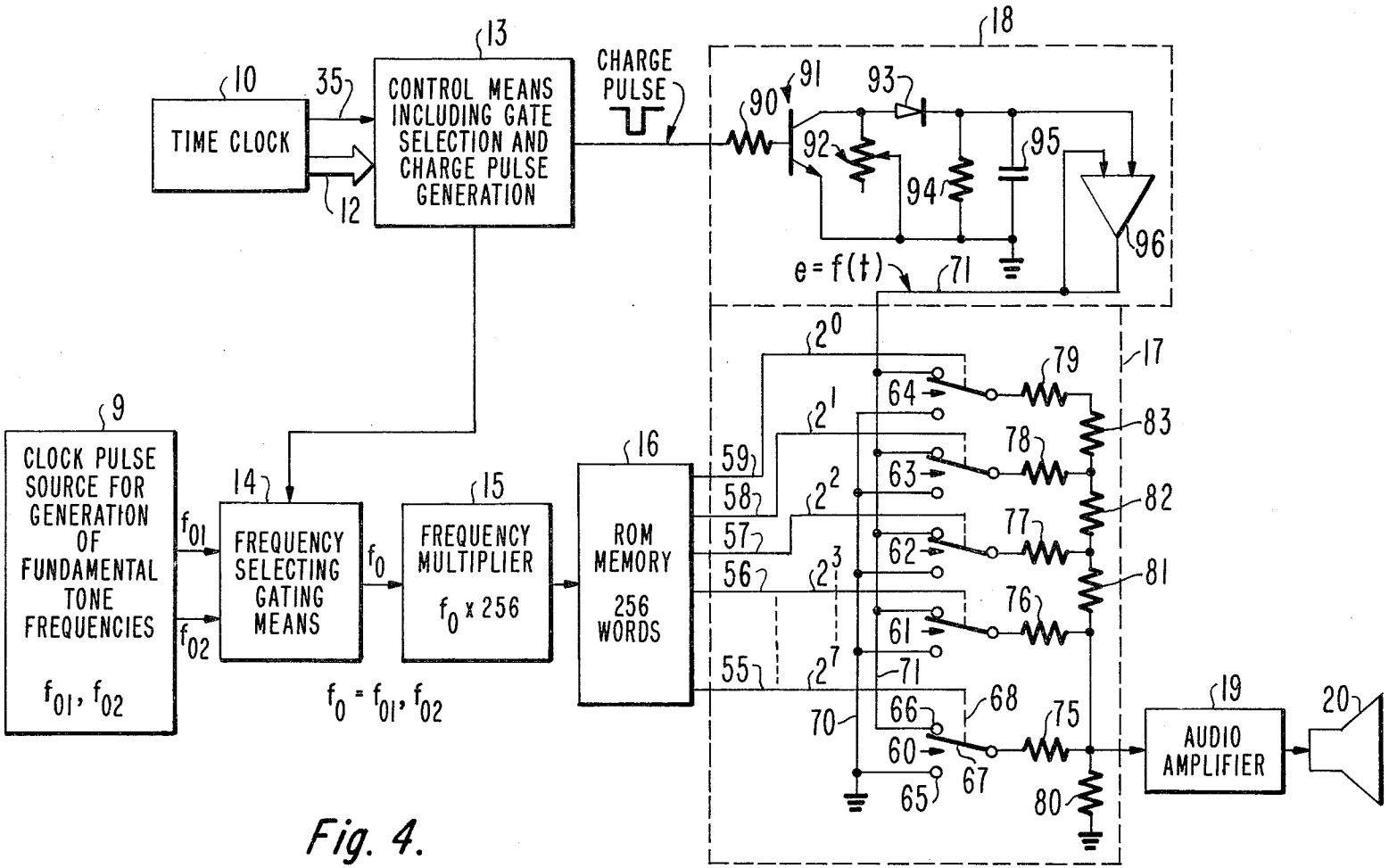
Figure 5:
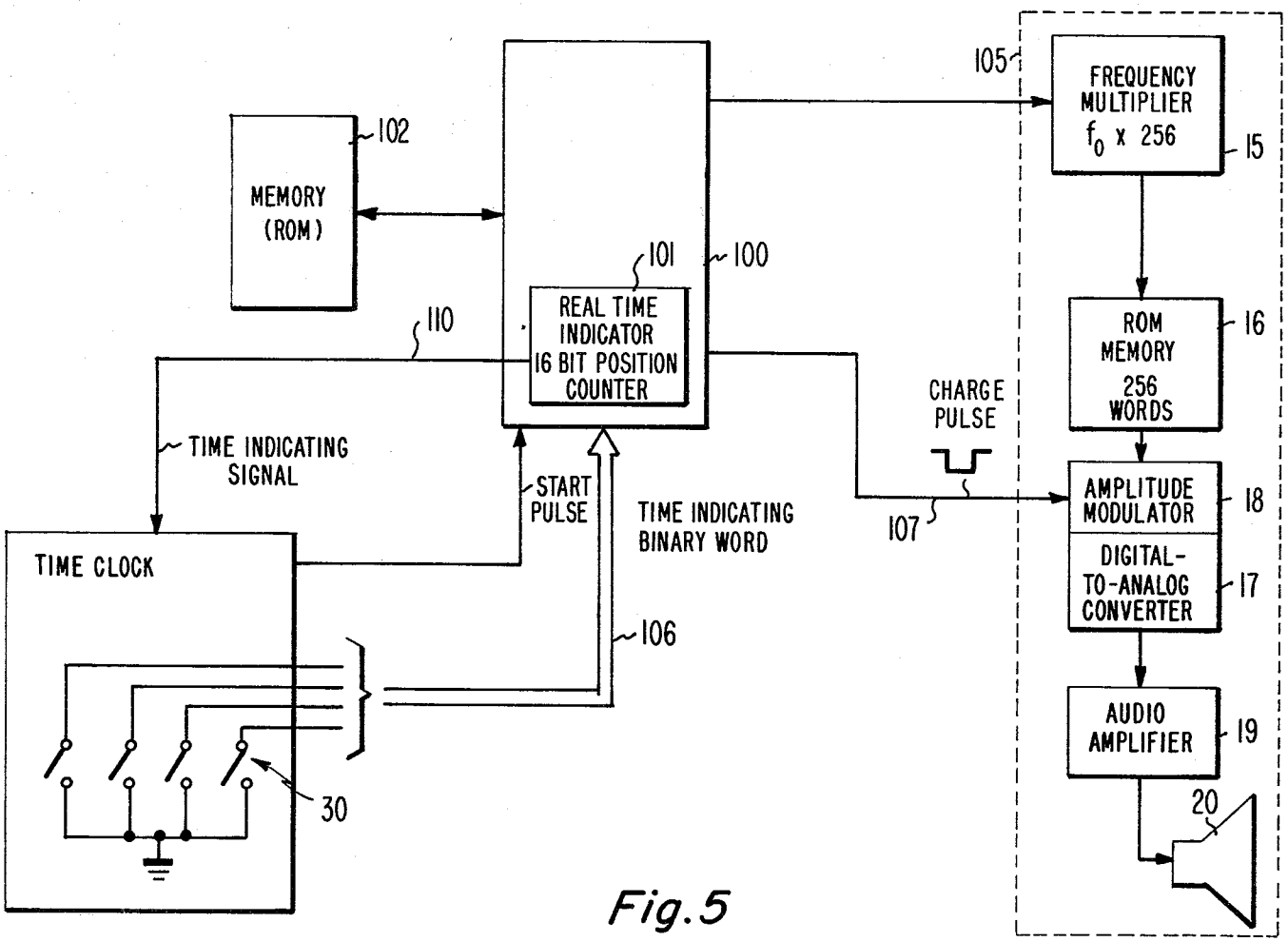
Figure 6:
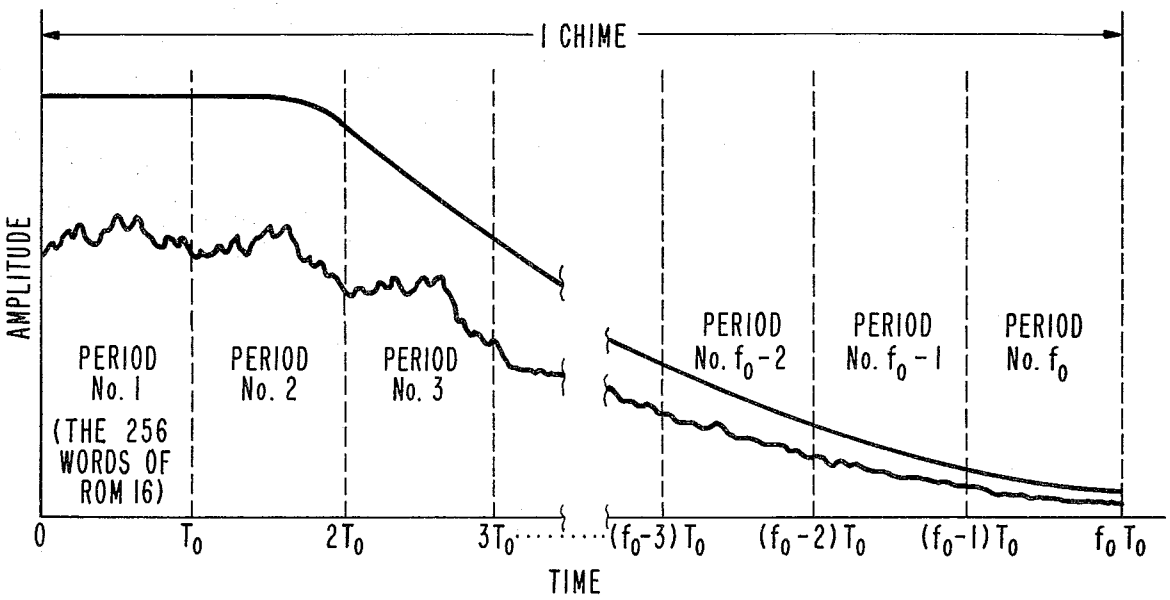
Figure 7:
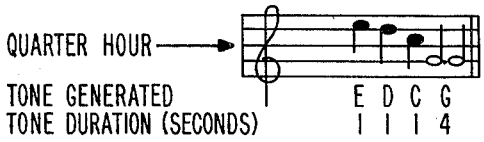
Figure 8:
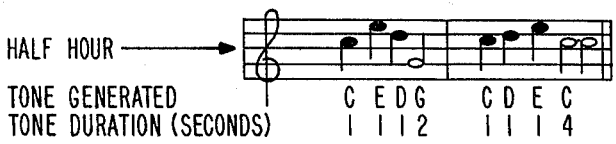
Figure 9:
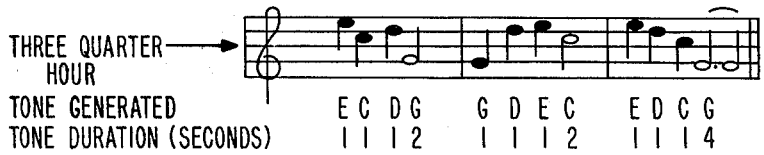
Figure 10:
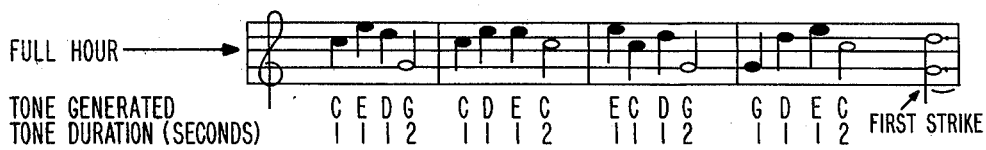

FIG. 4 also shows the same structure as does FIG. 1 but with schematic diagrams shown in lieu of some of the blocks of FIG. 1;

FIG. 5 is a block diagram of a second form of the invention employing a microprocessor to control the generation of the chimes;

FIG. 6 is a waveform of repeated generations of the waveform of FIG. 2 with an attenuation factor; and FIGS. 7–11 show the various chime sequences of the Westminster chimes for quarter, half, three quarter and full hour occurrences.

A basic concept of the invention is as follows. A waveform of one period $T_o$ of a bell or pipe sound, as shown in FIG. 2, is divided into equal vertical slices or sections of amplitude, such as section samples No. 1 and No. 2. Altogether, 256 of such amplitude sections are taken and each section is then transformed into a digital word representative of the amplitude. Such 256 amplitude representing words are stored in time sequential manner in the 256 word memory 16, which can be a read only memory (ROM) or a programmable type memory. By sequentially accessing the 256 words in ROM 16 at the proper cyclical accessing rate and converting such words to voltages in digital-to-analog converter 17 in time synchronous manner, and then supplying such voltages through audio amplifier 19 to speaker 20, the bell sound represented by the waveform of FIG. 2 can be reproduced. The proper cyclical accessing rate of ROM 16 is equal to the fundamental tone frequency of the chime desire. Thus, if there are 256 addresses in ROM 16, and the desired fundamental tone frequency is 132 Hz, the accessing frequency will be $132\times256$ Hz so that the cyclical accessing rate of the ROM 16 is 132 times per second, thereby establishing the fundamental tone frequency at 132 Hz. Further, the waveform of FIG. 2 contains the 3rd, 6th and 10th harmonics in the degree that they are present in a chime chime. Since the actual frequency of these harmonics are directly proportional to the rate at which the addresses of ROM 16 are sequenced, such harmonics will, in fact, be the 3rd, 6th and 10th harmonics of the cyclical scanning rate of ROM 16 whether such scanning rate be 132 Hz or 110 Hz.

With the foregoing explanation of the generation of a chime by sequencing the 256 addresses of ROM 16 in mind, a discussion of the block diagram of FIG. 1 follows.

In FIG. 1 a clock 10 is constructed to generate an electrical start pulse on lead 11 on the hour (although such start pulse could be generated, if desired, also at each quarter hour). The clock 10 also operates switches located therein (shown as switches 30 in FIG. 3) to indicate the time of day, i.e., on the hour, and if desired, at each quarter hour. For example, if the time is 8:00, the clock 10 will so indicate, and if the time is 8:45, the clock 10 can indicate the three quarter hour occurrence. There are a total of fifteen relevant time occurrences including twelve on-the-hour occurrences and three quarter hour occurrences. A four position switch encoded in binary fashion can indicate these fifteen relevant time occurrences.

The four bit position which can be any one of several well-known mechanical, electromechanical or electronic constructions operable by the position of the hour and minute hands, or the gears that operate the hands. The hour hand can operate the switches to indicate the hour and the minute hand to indicate when the full hour has occurred. The position of the minute hand also can trigger an electrical device, such as a one-shot multivibrator, to generate the start pulse. For example, if the time is 6:00 p.m. the hour hand will cause the four bit position switch to contain a binary 0110 and a start pulse is generated by the minute hand.

The state of such four bit position switch is transmitted via the leads in cable 12 to control means 13 which responds thereto to energize gating means 14 to select the tones of the proper fundamental frequencies from clock pulse source 9 to generate the appropriate chimes. More specifically, pulse source 9 is constructed to generate pulse trains at the various fundamental frequencies of the chime tones.

In a "BIM BAM" type chime, for example, such fundamental frequencies are 132 Hz and 110 Hz, with a repetition of the "BIM BAM" sound combination occurring on the full hour a number of times equal to the hour. The control means 13 senses the full hour time and allows the "BIM BAM" combination of fundamental frequency tones to be supplied through gating means 14 to frequency multiplier 15 the proper number of times, which to toll 6:00 p.m., for example, would be six times.

The frequency multiplier 15 multiplies the fundamental tone frequency for 256, which is the number of amplitude representing words stored in ROM 16. The frequency multiplier logic includes a divide-by-256 logic, as will be discussed later with respect to the structure of FIG. 3, which is employed to sequentially access and read out the 256 words in ROM 16. Such words are then supplied to digital-to-analog converter 17 which responds thereto to produce the voltage waveform of FIG. 2. This voltage waveform is then supplied to speaker 20 through audio amplifier 19 to reproduce the chime sound.

It should be noted that the 256 words in ROM 16 are accessed in sequence many times during the production of each time. For example, assuming each chime, i.e., the "BIM" sound and also the "BAM" sound to be one second in duration and the fundamental tone frequency to be 132 Hz, the 256 words in ROM 16 will be accessed completely 132 times.

Figure 3:
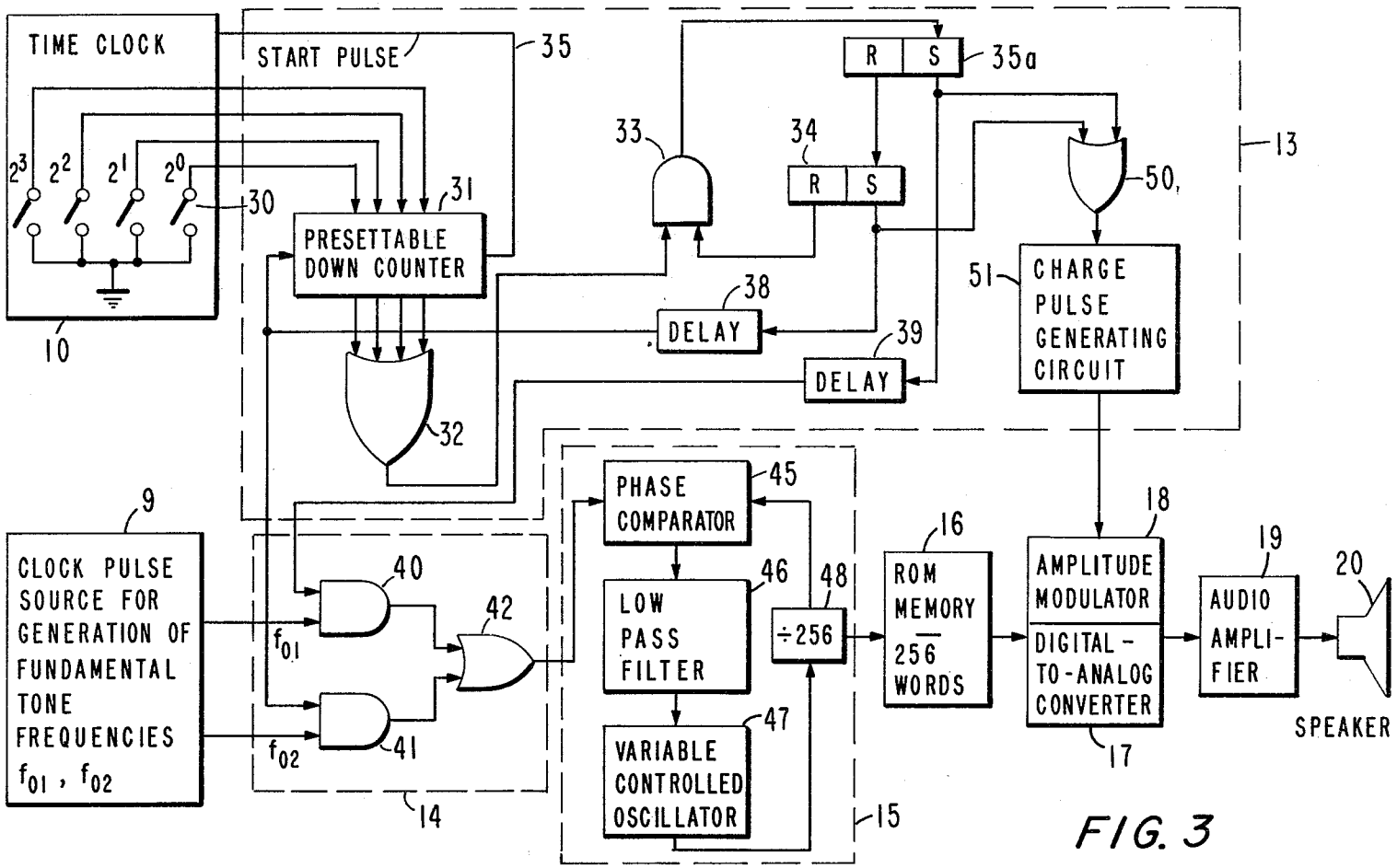
FIG. 3 shows the same structure as does FIG. 1 but with suitable logic shown in lieu of some of the blocks of FIG. 1.

FIG. 3 shows the same structure as does FIG. 1 except that the logic needed to perform the functions of the control means 13 and the frequency selecting gating means 14 of FIG. 1 is shown in FIG. 3. Also a more detailed diagram of the frequency multiplier 15 is shown in FIG. 3.

The four position binary switch 30 can be operated by time clock 10 in response to full hour, and if desired, also to the quarter, half and three quarter hour occurrences to set presettable down counter 31 to a count value indicating the time. Specifically, the presettable down counter 31 is set to a count equal to the hour upon the occurrence of a full hour and could be set to a count of one upon the occurrence of a quarter, half or three quarter hour.

Usually, however, the presettable counter 31 is not set until the clock time reaches a full hour at which time a start pulse is generated within the clock 10 and is supplied via lead 35 to preset down counter 31 to a count determined by the full hour time. Assume such count to be three, for discussion purposes. The setting of a count in counter 31 will produce an output from OR gate 32 which will pass through AND gate 33, already primed by the reset state of monostable device 34. The output from AND gate 33 will set the normally reset monostable device 35*a* to prime AND gate 40 (through delay means 39) in the frequency selecting gating means 14, to thereby pass the fundamental tone clock pulse signal of frequency $f_{o1}$ therethrough to OR gate 42 and then to phase comparator 45 of frequency multiplier 15. The output of the phase comparator 45 is supplied to a low pass filter (LPF) 46, the output of which is supplied to a voltage controlled oscillator (VCO) 47 whose output, in turn, is supplied to divider 48. Because divider 48 divides by 256, the frequency of the VCO 47 is $256 \times f_{o1}$. The divider 48 is, in fact, a counter whose function is not only to divide the frequency of the VCO output, but also to sequentially access the 256 words stored in ROM 16 at a cyclical rate of $f_o$.

As discussed above, the amplitude representing words of ROM 16 are supplied to DAC 17 where they are converted to the voltage waveform of FIG. 2 which is then supplied to audio amplifier 19.

Returning again to the operation of the logic control circuit 13, the monostable device 35*a* is designed to remain set for about one second, the duration time of a chime. At the end of a second, the monostable device 35*a* resumes its normally reset state which results in the setting of monostable device 34. The setting of device 34 enables AND gate 41 (through delay means 38) to pass the fundamental tone of frequency $f_{o2}$ therethrough to OR gate 42 and then to frequency multiplier 15 where it results in causing the voltage controlled oscillator 47 to generate an output signal of frequency $256 \times f_{o2}$. All of the 256 words of ROM 16 are scanned 132 times per second since $f_{02} = 132$, thus establishing the fundamental tone frequency of the reproduced audio output from speaker 20 at 132 Hz.

Returning again to the logic within control circuit 13, the monostable device 34 performs another function in addition to enabling AND gate 41. Specifically, the setting of monostable device 34 results in the decrementing of the count in down counter 31 by one, from the assumed count of three to a count of two.

After about one second, the monostable device 34 resets so that a pulse is again set through AND gate 33 (already primed by an output signal from OR gate 32) to again set monostable device 35. Monostable device 35*a* remains set for one second during which time AND gate 40 is enabled to pass the fundamental tone of frequency $f_{o1}$ therethrough, and then through OR gate 42 and frequency multiplier 15 to access ROM 16 in the manner described above.

Upon becoming reset after one second, monostable device 35*a* causes monostable device 34 to become set again, thereby enabling AND gate 41 to pass the fundamental tone of frequency $f_{o2}$ to pass therethrough and then through OR gate 42 and frequency multiplier 15 to access ROM 16 in the manner described above.

The setting of monostable device 34 again results in the decrementing of down counter 31 by a count of one, thus reducing its contained count from two to one.

The monostable devices 35*a* and 34 are both set and reset once again to pass the fundamental tones of frequencies $f_{o1}$ and $f_{o2}$ through AND gates 40 and 41 for the third time in the manner described above, and also to reduce by one the count in down counter 31 to a resultant contained count of zero.

A count of zero in down counter 31 terminates the operation of the control circuit 13 since there is no output from OR gate 32 and AND gate 33 is thereby disabled. Monostable device 35*a* will no longer become set when monostable device 34 becomes reset.

As discussed above, the digitized amplitude representing words from ROM 16 are converted to the voltage waveform of FIG. 2 by DAC converter 17. Specifically, when the fundamental tone frequency is 132 Hz, the waveform of FIG. 2 will be reproduced 132 times per second in continuous manner. In order to provide the necessary amplitude attack and decay characteristics, the amplitude modulator 18 (shown in detail in FIG. 4) is energized at the beginning of each chime by a charge pulse supplied from charge pulse generating circuit 51. Th charge pulse generating circuit is energized by pulses supplied thereto through OR gate 50 each time either monostable device 34 or 35*a* is set which, as discussed above, initiates the generation of a chime. The delay means 38 and 39 assure that the charge pulse is generated before the chimes are initiated.

The DAC 17 can be a conventional eight stage ladder network comprised of a plurality of series resistors, such as resistors 81–83, each having a value R, a plurality of shunt resistors, such as resistors 75–79, each having a value 2R and a load resistor 80 having a value 2R. Each of the eight output terminals, such as terminals 55–59, of the 256 word ROM 16 ($2^8=256$) is employed to operate one of the eight switches, such as switches 60–64, each of which is comprised of a pair of contacts 65 and 66, as shown in switch 60, and an armature 67. Specifically, for example, if a binary 0 appears on output terminal 55 of ROM 16, the armature 67 is moved from its normally closed connection to bus bar 71 through contact 66 to make contact with ground bus 70 through contact 65 by means of linkage 68. Each of the other switches 61–64 are operated in a similar manner by binary 1's appearing on output terminals 56–59, respectively, from ROM 16. The switches 60–64 can be electronic switches rather than electromagnetic.

Different combinations of closed switches 60–64 produces different voltages across output load resistor 80 in accordance with the well-known relation, $$I_{TOTAL} = \frac{e}{3R(2^N)}[\cdots + D2^3 + C2^2 + B2^1 + A2^0]$$

where coefficients D, C, B and A represented the state of switches 60–64 of FIG. 4; where R represents the value of resistors 81–83; where e is the voltage e=f(t) of FIG. 4; and where $I_{TOTAL}$ is the total current through load resistor 80 of FIG. 4.

If each binary value of 1 produces an output voltage of 0.1 volt across load resistor 80, the presence of a binary value 1,000 1001 on output terminals 55–59 of ROM 16 will connect the arms of switches 60, 61, and 64 to the voltage bus bar 71 and produce a total voltage of 12.8 volts $(2^7\times0.1)+0.8$ volts $(2^3\times0.1)+0.1$ volts $(2^0\times0.1)=14.1$ volts across load resistor 80.

The amplitude modulator 18 modulates the output voltage of DAC 17 to simulate exponential decay of a chime in the following manner. The charge pulse, which occurs slightly before the accessing of ROM 16 due to delay means 38 and 39 of FIG. 3, is supplied through resistor 90 to the base of amplifying transistor 91 whose collector-emitter voltage is controlled by variable resistor 92. The collector output of transistor 91 is supplied through diode 93 to charge capacitor 95 to a value determined by the collector potential. At the termination of the charge pulse, capacitor 95 discharges through resistor 94 at a rate determined by the RC time constant. The decaying voltage on capacitor 95 is supplied to bus bar 71 through high input impedance unity amplifier 96 to provide the reference voltage e=f(t) for the ladder network of DAC 17.

The resulting output from DAC 17 is shown in FIG. 6 wherein there are $f_o$ periods (reproductions) of the waveform of FIG. 2 shown, with each succeeding period $T_o$ being progressively attenuated by the operation of amplitude modulator 18. During the time period 0 to $T_o$ in FIG. 6, the attenuation curve is relatively flat to simulate the attack portion of a chime.

While the structure of FIGS. 1–6 has been directed to a two-chime, BIM BAM type sound, the hard wired logic can be expanded to generate other chime sequences such as the Westminster chimes and strikes shown in FIGS. 7 through 11. Such expansion of logic requires, generally, four fundamental tones of the frequencies needed to generate the notes C, D, E and G, gating and control logic to recognize the quarter hour, the half hour, the three quarter hour and the full hour to gate the four fundamental tones in proper sequence to generate the chime sequences of FIGS. 7, 8, 9 and 10, respectively, and with the proper time duration for each chime.

All of the four different chimes (C, D, E and G) are generated by multiplying the fundamental tone by a frequency multiplier, such as the frequency multiplier 15 of FIG. 1, and then sequentially accesing the 256 words in ROM 16 in the manner described above with respect to FIGS. 1–6. Different shaped charge pulses might be desirable since some of the chimes have longer time durations than others.

In lieu of hard wired logic, a microprocessor and an additional memory can be employed to generate the proper fundamental tones in the proper sequence and of the proper duration. Reference is made to FIG. 5 which shows the block diagram of such an embodiment.

When a data processor 100 is employed, the time of day (12 hours) can be maintained in a 16 bit position counter 101. Upon the occurrences of the full hour, 15 minutes after the hour, 30 minutes after the hour and 45 minutes after the hour, the processor will access the proper one of several tables in a memory 102, which can be a ROM.

The aforementioned tables can be five in number, with each table representing one of the five chime sequences of FIGS. 7 through 11. As a specific example, the ROM 102 will contain a particular table listing, in sequential order, binary words defining the fundamental tones of the chime sequence of FIG. 9, and the time duration of each tone. At each quarter hour occurrence the processor will access such particular table in ROM 102 and ROM 102 will sequentially supply to the processor, under processor control, the words in the accessed table. The processor will respond to such words to generate a corresponding sequence of fundamental frequency tones which are supplied to the frequency multiplier 15 of the sound synthesizer 105.

Figure 11:
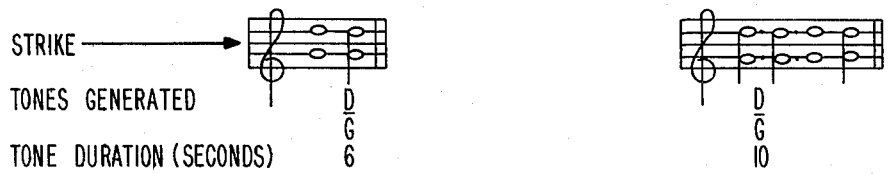

The strikes shown in FIG. 11 follow the chimes to indicate the full hour and are generated in substantially the same manner as are the chimes of FIGS. 7–10. However, in order to generate a strike sound with two fundamental tones, it is necessary to add a second circuit (not shown) comprised of a duplication of frequency multiplier 15, memory 16, amplitude modulator 18 and digital-to-analog converter 17.

The two fundamental frequency tones are each individually supplied to one of the inputs of the two frequency multipliers and the resulting analog output signals of the two digital-to-analog converters are added together and then supplied to audio amplifier 19.

In generating the strikes the processor 110 will, at each full hour, set an internal down counter to a count equal to the hour, which can be 6:00 p.m. for example. At the termination of the chime sequence of FIG. 10, the processor will access the table in the ROM containing the strike sequence of FIG. 11 and will generate six strike tones, with each strike tone decrementing the down counter by a count of one. The generation of the sixth strike tone will set the counter to zero and terminate the strike sequence.

As an alternative to generating the real time of day within the processor (real time indicator 101) such time can be generated within the clock mechanism by means of switches 30, in the manner described with respect to FIGS. 1–6, and sensed by processor via leads. Also the start pulse can be generated within the clock mechanism, as discussed re FIGS. 1–6, and supplied to the processor via leads 106.

It will be apparent to one skilled in the art that processors of various capabilities can be employed and programmed in many ways to generate the required patterns of fundamental tones. Further, it is possible to include the function of the frequency multiplier 15 and the memory 16 within the processor if the capacity and speed thereof are sufficient. Also, the real time computed within the processor can be employed to drive the hands of the clock through time indicating lead 110.

The sound synthesizer 105 contains the same blocks 15, 16, 17, 18, 19 and 20 as does the structure of FIG. 1 and operate in much the same manner. Specifically, the frequency multiplier 15 (which can be a phase lock loop system) multiplies the fundamental tone frequency $f_o$ by 256 with the divider therein (equivalent to divider 48 of FIG. 3) being employed to access the 256 words of ROM 16 which represent, in digitized form, a period $T_o$ of the waveform of FIG. 2.

The binary word output of ROM 16 is converted in DAC 17 to the voltage waveform of FIG. 2, but with its amplitude modulated by means of amplitude modulator 18 as shown in FIG. 6.

The duration of the charge pulse supplied to the amplitude modulator 18 of sound synthesizer 105, from processor 100, via lead 107, can be lengthened in order to sustain the sound of the longer notes of the chimes. For example, the last notes G and C of the first two bars of the three quarter hour chime, are half notes and are twice as long in duration as the preceding quarter notes.

The invention is not limited to clock chimes. It can be employed in many other tone generation applications such as piano, organs, wind instruments, horns, sirens or doorbell chimes, for example.

What is claimed is:

1. An electronic chime clock comprising:

a clock comprising means for indicating the time of day; and means for generating selected chime sequences comprising:

memory means containing N sequentially stored binary words represented successive amplitude samplings of a periodic waveform of period $T_o$ which contains predetermined harmonics of the fundamental tone frequency $f_o$, where $f_o=1/T_o$ $f_{o1}, f_{o2} \ldots f_{on}$;

accessing means including means for generating scanning signals of frequencies $Nf_{o1}, Nf_{o2} \ldots Nf_{on}$ for reading out the binary words stored in said memory means; means for determining times of day control means responsive to predetermined times of day to supply predetermined sequences of said scanning signals to said accessing means to iteratively read out the N binary words stored in said memory means; and means for converting said read out binary words into audible chime sequences.

2. Tone generating means comprising:

first memory means containing N sequentially stored binary words representing successive amplitude samplings of a periodic multi-frequency stored waveform of period $T_o$ which contains predetermined harmonics of the fundamental tone frequency $f_o$, where $f_o=1/T_o=f_{o1}, f_{o2} \ldots f_{on}$; and accessing means for sequentially reading said N binary words from said first memory means at a frequency $Nf_o$, where the reading frequency $Nf_o$ can be any selectable one of a plurality of reading frequencies $Nf_{o1}, Nf_{02} \ldots Nf_{on}$, with the selected reading frequency thereby becoming the fundamental tone frequency of said multi-frequency waveform;

indicating means for indicating the time of day;

said accessing means comprising signal generating means for generating signals of said reading frequencies $Nf_{o1}, Nf_{o2} \ldots Nf_{on}$; and control means comprising timing means and gating means responsive to said indicating means to energize said gating means to gate predetermined ones of said signals therethrough at predetermined times and for predetermined time intervals in accordance with said timing means to read out the N binary words stored in said memory means.

3. A tone generating means as in claim 2 and further comprising:

digital-to-analog converting means responsive to said read out amplitude sampling representing words to generate a resultant voltage waveform consisting of at least one period $T_o$ of said stored waveform; and amplitude modulating means responsive to the beginning of each tone generation to modulate the amplitude of said resultant voltage waveform to simulate the attack and decay characteristics of an initially excited and subsequently freely resonating body.

4. A tone generating means as in claim 2 and further comprising:

second memory means containing a plurality of tables of words defining the sequence and the time duration of a plurality of tones of fundamental frequencies $Nf_{o1}, Nf_{o2} \ldots Nf_{on}$, with each table defining a particular time of day occurrence;

means responsive to predetermined indicated times of day to access a particular table in said second memory means;

means responsive to the words in said accessed table to generate a series of tones of predetermined frequencies of the frequencies $Nf_{o1}, Nf_{o2} \ldots Nf_{on}$; and means responsive to said predetermined ones of said frequencies $Nf_{o1}, Nf_{o2} \ldots Nf_{on}$ to access the N word locations in said first memory means at said frequencies $Nf_{o1}, Nf_{o2} \ldots Nf_{on}$.

5. A tone generating means as in claim 2 in which said signal generating means comprises:

a phase lock loop system comprising phase comparator means, filter means, voltage controlled oscillator means and divide-by-N means arranged serially in the order listed, and responsive to individual ones of said fundamental tone signals to generate a signal of frequency $Nf_o$ at the output of said voltage controlled oscillator means;

said divide-by-N means responsive to the output signal of said voltage controlled oscillator means to count through its capacity every $T_o$ time period; and in which said first memory means is responsive to the output of said divide-by-N means to read out said stored binary words.

6. A multi-frequency waveform generator comprising:

first memory means comprising N sequentially accessable addresses each containing an amplitude representing word of successive equal time sections of a periodic waveform of a period $T_o$, in which said periodic waveform contains predetermined harmonics of a fundamental tone of frequency $f_o$, where $f_o=1/T_o=f_{o1}, f_{o2} \ldots f_{on}$; indicating means for indicating time;

control means for repeatedly accessing in a sequential manner the words in said N addresses at a scanning frequency $Nf_o$, where $f_o=f_{o1}, f_{o2} \ldots f_{on}$ and comprising:

said control means further comprising signal generating means for generating scanning signals of said frequencies $Nf_{o1}, Nf_{o2} \ldots Nf_{on}$;

in which said control means further comprises timing means and gating means responsive to the said indicating means to energize said gating means to gate predetermined ones of said scanning signals therethrough at predetermined times and for predetermined time intervals in accordance with said timing means to scan the N addresses of said memory means; and means for converting said accessed words to voltages to reproduce said periodic waveform having the fundamental tone frequency of $f_o=f_1, f_2 \ldots f_{on}$, in accordance with the scanning frequency $N f_o$ employed to access said N words from said memory means.

7. A multi-frequency waveform generator as in claim 6 and further comprising:

amplitude modulating means responsive to the accessing of said words to modulate the amplitude of said reproduced waveform in a manner to simulate the decay of a freely resonating body.

8. A tone generating means as in claim 6 in which said signal generating means comprises:

a phase lock loop system comprising phase comparator means, filter means, voltage controlled oscillator means and divide-by-N means arranged serially in the order named and responsive to individual ones of said fundamental tones to generate a signal of frequency $Nf_o$ at the output of said voltage controlled oscillator means; 'said divide-by-N means responsive to the output signal of said voltage controlled oscillator means to count through its capacity every $T_o$ time period; and said first memory means responsive to the output of said divide-by-N means to generate said stored binary words.

9. A multi-frequency waveform generator as in claim 6 and in which said control means comprises:

second memory means containing a plurality of tables of words defining the sequence and the time duration of a plurality of tones of fundamental frequencies $f_{o1}, f_{o2} \ldots f_{on}$, with each table defining a particular time of day occurrence;

means responsive to predetermined indications of the time of day to access a particular table in said second memory means;

means responsive to the words in said accessed table to generate a series of tones of predetermined ones of the frequencies $Nf_{o1}, Nf_{o2} \ldots Nf_{on}$; and means responsive to said predetermined ones of said frequencies $Nf_{o1}, Nf_{o2} \ldots Nf_{on}$ to scan the N words in said first memory at said frequencies $Nf_{o1}, Nf_{o2} \ldots Nf_{on}$.

10. Digitized multi-frequency tone generating means comprising:

a digital memory comprising N sequentially addressable word locations each containing a readable binary word which collectively represent successive, equally time-spaced amplitude samples of a predetermined voltage waveform which represents a period $T_o$ of a multi-frequency tone containing a fundamental tone of frequency $f_o$ and predetermined harmonics thereof when a period $T_o$ of said waveform is reproduced at a rate $f_o$;

signal generating means comprising counting means of count capacity N for generating a plurality of memory accessing signals of frequency $N f_o$, where $f_o$ represents selectable fundamental tones of different frequencies;

said counting means constructed to read out in sequential manner the N binary words stored in said digital memory at a rate $N f_o$; and means responsive to said binary words to reproduce said predetermined voltage waveform;

indicating means for indicating time; and control means comprising timing means and gating means responsive to the said indicating means to energize said gating means to gate predetermined ones of said accessing signals therethrough at predetermined times and for predetermined time intervals in accordance with said timing means to access the N addresses of said memory means.

* * * * *

UNITED STATES PATENT AND TRADEMARK OFFICE
CERTIFICATE OF CORRECTION

PATENT NO. : 4,245,336

DATED : January 13, 1981

INVENTOR(S) : Horst Stietenroth

It is certified that error appears in the above-identified patent and that said Letters Patent is hereby corrected as shown below:

Column 4, line 64, change "Th" to ---The---;

Column 5, line 36, change "1,000 1001" to ---1 000 1001---;

Column 7, claim 1, line 50-51, after "$1/T_0$" insert an equal sign ---=---;

Column 9, claim 8, line 47, cancel period and apostrophe (.') after "oscillator means" and start as a new paragraph at ---said divide---.

Signed and Sealed this

*Twenty-first* Day of *July 1981*

[SEAL]

*Attest:*

GERALD J. MOSSINGHOFF

*Attesting Officer*

*Commissioner of Patents and Trademarks*